United States Patent [19]

Haselton

[11] 3,969,775

[45] July 20, 1976

[54] WATER CLOSET FLUSHING DEVICE

[76] Inventor: Frederick R. Haselton, 1205 Fallsmead Way, Rockville, Md. 20850

[22] Filed: Jan. 6, 1975

[21] Appl. No.: 538,617

Related U.S. Application Data

[63] Continuation of Ser. No. 421,599, Dec. 4, 1973.

[52] U.S. Cl. ..... 4/67 A; 4/34; 4/37; 4/57 P; 4/67 R; 4/DIG. 1

[51] Int. Cl.[2] ..... E03D 1/34; E03D 5/02; A61B 19/00

[58] Field of Search ..... 4/56, 57 R, 57 P, 67 R, 4/67 A, 34, 38, 37, DIG. 1, 55, 58, 60, 61

[56] References Cited

UNITED STATES PATENTS

| | | | |
|---|---|---|---|
| 1,890,281 | 12/1932 | Dollinger | 4/58 |
| 2,290,679 | 7/1942 | Edes | 4/57 R |
| 2,724,838 | 11/1955 | Wirth et al. | 4/DIG. 1 |
| 2,754,521 | 7/1956 | Marcum | 4/57 R |
| 2,817,849 | 12/1957 | Hewitt | 4/DIG. 1 |
| 3,546,715 | 12/1970 | Wustner | 4/67 A |
| 3,707,733 | 1/1973 | Gore et al. | 4/57 P |
| 3,733,618 | 5/1973 | Wiegand | 4/57 R |

*Primary Examiner*—Henry K. Artis
*Attorney, Agent, or Firm*—Pollock, Vande Sande & Priddy

[57] ABSTRACT

The disclosed device provides a normal minimum flush cycle for water closets with the ability to override the short cycle to cause a larger water volume flush cycle. The conventional tank flapper dump valve is modified so as to retain no buoyancy during the flush cycle and a positively buoyant member is adjustably fixed on the valve operating chain an appropriate distance from the valve. When the operating handle is actuated, the added buoyancy holds the valve open while the water level in the tank falls until the added buoyancy member surfaces at which time the valve closes and the tank refills normally. Short cycle override is accomplished by merely holding the handle in the actuated position allowing a greater portion of the water in the reservoir to pass.

2 Claims, 4 Drawing Figures

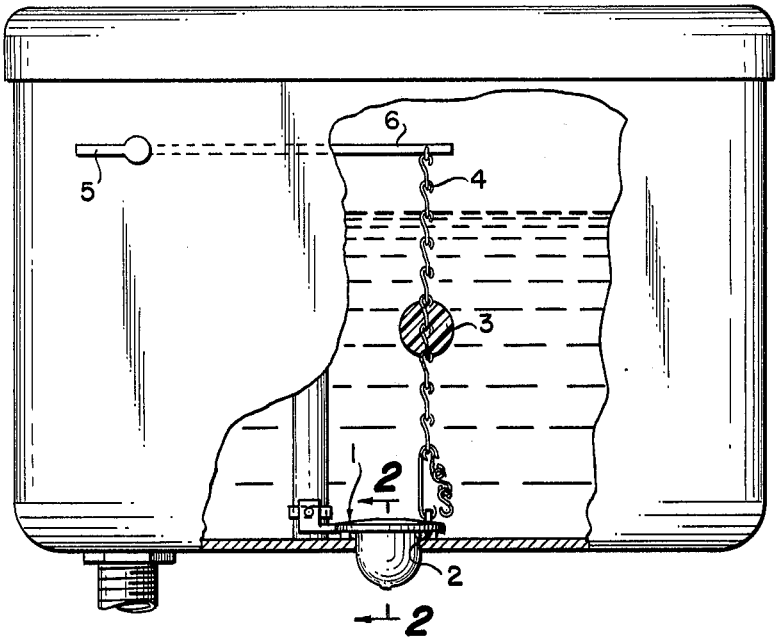
Fig. 2
Fig. 1
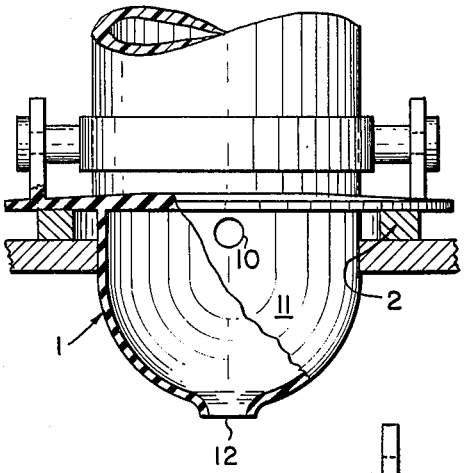
Fig. 3
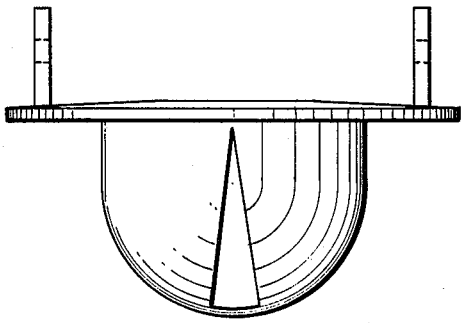
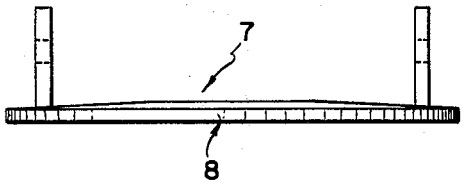
Fig. 4

WATER CLOSET FLUSHING DEVICE

This is a continuation of application Ser. No. 421,599, filed Dec. 4, 1973.

BACKGROUND OF THE INVENTION

While a very large number of systems have been developed to save water in the flushing of water closets, most require unacceptable alterations to the mechanisms extant and therefore have not come into popular use.

Since the invention of the modern flushing water closet, about 1870, there have been many patents issued disclosing several fundamental concepts for saving water. The largest number of patents present two preset dump valve levels within a reservoir, each with its own valve and valve seat. The valves may be, generally, separately operated by a variety of novel means whereby the reservoir is emptied to either of two levels at the option of the operator. While the principle is sound, the modifications required to the existing water closets precludes their practical implementation. The second largest group of patents addresses multiple or divided reservoirs which, for economical reasons, are not likely contenders to deal with the predicted water supply and disposal crises. A variety of other means are presented including weighted floats and decreasing buoyancy float valves.

The main obstacle to the adoption of any of the schemes disclosed in the prior art is that of economics. Despite the preponderance of evidence that fresh water is becoming a scarce commodity and that sewage disposal presents an ever increasing problem, individuals are unwilling to undertake the cost and inconvenience of even modest conversions of their water systems. In the United States it has been determined that about forty-five percent of the domestically used water is consumed in the WC flushing process. Whereas such simple expediencies as placing a brick in the reservoir will conserve a small amount of water with each flush — about five percent — it does not solve the problem at hand.

OBJECT OF THE INVENTION

It is therefore an object of the present invention to provide an inexpensive and easily installed WC flush valve which will readily substitute for the great majority of modern flushing valves and which will permit the saving of about one half the water presently being used in the flushing process.

It is a further object of the invention to provide the operator with the option of a full tank flush override capability while the normal actuation of the flush handle initiates an automatic partial reservoir flush, which is adequate for most needs.

The present invention provides a direct replacement reservoir dump valve which may be easily installed as normal-wear-out replacement occurs. Thus, ultimately, if the valve were to become universally available, all WC reservoirs could become converted so that only about twenty percent of the domestically used water would be consumed in the flushing of water closets.

DESCRIPTION OF THE DRAWING

FIG. 1 is an elevational view partially in cross-section of the valve and associated float arrangement of the present invention.

FIG. 2 is a front view of the valve in the preferred configuration.

FIG. 3 is an elevational view of an alternate embodiment of the valve.

FIG. 4 is an elevational view of a further modification of the valve.

Note that only those elements of the reservoir associated with the actual flush process are shown whereas those utilized for refilling the reservoir are omitted as irrelevant to the present invention.

DETAILED DESCRIPTION OF THE PREFERRED EMBODIMENT

The present invention includes means for automatically using a preset amount of water from the WC reservoir tank for each momentary operating lever actuation while permitting a manual override capability to use a greater amount of water when desired. Although the prior art has used various other WC reservoir selectable water level devices, the present invention contemplates a buoyancy member separated from the dump valve by a preselectable distance. For the normal modern WC, this buoyancy member is conveniently attached to the dump valve actuating chain; however, it may be attached to the valve by another linkage if desired.

FIG. 1 illustrates in diagrammatic and cross-sectional form one means, i.e. the float 3, for providing the buoyancy required to maintain the dump valve in the open position during the short flush cycle as well as one means of adjusting the distance between the float and the valve. FIG. 2 discloses the vent and flood holes which allow the dump valve to rapidly fill with water thereby losing all buoyancy. Normally, the dump valve commonly used is as shown in FIGS. 1 and 2, but without the aperture 10 shown in FIG. 2. Consequently, with the valve in its normal closed position, any water in the chamber 11 runs out through the port 12 located at the bottom of the chamber. As a result, the chamber is normally filled with air and thus has a positive buoyancy, thereby ensuring that the valve will quickly open and stay open when the valve is initally opened. Such conventional dump valve, however, because of its normally air-filled chamber, tends to stay open until such time as the water has all run out of the tank or reservoir, at which time it drops to the closed position and any water which may have accumulated in the chamber 11 then runs out through port 12. To prevent this mode of operation, an additional aperture 10 is formed which permits the quick flooding of the chamber as soon as the valve opens, thereby giving the valve a negative buoyancy so that it will quickly close as soon as permitted by chain 4 and float 3. In this way, the valve normally does have a positive buoyancy to aid in its quick opening but quickly acquires a negative buoyancy to permit its closing before all the water has run out of the tank. The wall of the conventional buoyant chamber, found in the common molded one piece dump valve 1, also serves to guide the dump valve properly onto the valve seat 2 thereby assuring a proper closure after each flush. This venting chamber contributes momentarily to the upward lifting force of the added buoyancy member 3 thereby assuring a rapid and positive opening of the dump valve when the chain 4 is actuated by the handle 5 through lever 6. The member 3 has sufficient buoyancy to retain the dump valve in the open position, in opposition to the flow of water past this valve, until the reservoir water level falls sufficiently to result in closure of the dump valve. This occurs when the combined effects of loss of buoyancy of member 3, the negative buoyancy of the dump valve 1, and the outflow of water past this valve result in a net closure motion of the dump valve 1.

FIG. 3 illustrates an alternate means of accomplishing the flooding and venting of the dump valve.

FIG. 4 illustrates in diagramatic and cross sectional form an alternate means of accomplishing the same end result as that obtained by the embodiment of FIGS. 1 and 2. In this variation the dump valve 7 contains no venting chamber and the under surface 8 provides a larger seating area making valve alignment less critical. when this alternate configuration is substituted for the valve 1 of FIG. 1 the chain 4 is actuated by the handle 5 through lever 6 the valve 7 is lifted off seat 2 where it remains uner the positive buoyant force of a larger buoyant member 3 until, as before, the water level in the reservoir falls sufficiently to result in closure of valve 7 when the decreasing positive buoyancy of member 3 can no longer counter the weight of valve 7 and the forces of the outrushing water flowing past valve 7. Whereas this means does not provide the seating guidance or the additional initial buoyancy of the perferred embodiment, no experimental evidence exists to date as to the advantage of either over the other.

In summary, when handle 5 is momentarily actuated it, in turn, through lever 6, places a tension in chain 4 which is attached to dump valve 1 causing it to be lifted off seat 2. Once pulled off the seat 2 to the fully open position, valve 1 is held open by buoyancy member 3 until the reservoir water level falls sufficiently to cause the tension in chain 4 to be lessened by the loss of buoyancy of member 3, allowing valve 1 to close. if a larger volume of water is desired for a more vigorous flush, the valve 1 may be manually held open by holding operating handle 5 in the actuate position.

While I have thus described herein two specific variations of a single fundamental apparatus in schematic form, it would be obvious to those skilled in the art that many individual variations may be made therein without departing from the spirit or scope of the invention.

I claim:

1. A flush control mechanism for a water closet of the type having a flushing fluid storage reservoir whose contents are transferred selectively either in part or substantially entirely to a bowl to flush the bowl comprising:

valve means in said reservoir selectively operable between open and closed positions and having a negative buoyancy characteristic at least when said valve means is open, said valve means normally assuming the closed position but when operated to its open position permitting the flow of flushing fluid to said bowl, said valve means comprising an enclosed chamber having a vent aperture at its bottom which is isolated from the fluid in said reservoir when said valve means is closed to thereby permit emptying of said chamber during closure of said valve means, said valve means further including an additional fluid entry aperture in said chamber upwardly of said vent aperture for permitting entry of fluid into said chamber only when said valve means is opened, whereby said chamber has positive buoyancy when said valve means is closed but quickly becomes flooded and acquires negative buoyancy upon opening of said valve means, a manually operated means operable between a first normal position and a second flushing position, and means responsive to a momentary actuation of said manually operated means to its second position for opening said valve means only until a predetermined portion of the fluid in said reservoir which is less than the full quantity thereof has been transferred to said bowl, said last-named means being responsive to a continued actuation of said manually operated means to its second position to maintain said valve means in its open position as long as said manually operated means remains in its said second position to permit transfer of substantially all of the fluid in said reservoir to said bowl.

2. The flush control mechanism of claim 1 wherein said valve means includes a valve seat and a movable element selectively movable into a sealing engagement with said valve seat, said movable element defining a bottom-vented chamber fitting within said valve seat when said valve means is closed, and at least one additional water inlet aperture for admitting flushing fluid to said chamber as soon as valve means is opened to thereby impart a negative buoyancy to said movable element.

* * * * *